US005391961A

United States Patent [19]

Tsuchiya et al.

[11] Patent Number: 5,391,961

[45] Date of Patent: Feb. 21, 1995

[54] GAS-FILLED DISCHARGE TUBE

[75] Inventors: Hiromitsu Tsuchiya; Takahisa Suzuki; Takashi Sato, all of Shizuoka, Japan

[73] Assignee: Yazaki Corporation, Tokyo, Japan

[21] Appl. No.: 35,605

[22] Filed: Mar. 23, 1993

[30] Foreign Application Priority Data

Apr. 13, 1992 [JP] Japan ..... 4-023262[U]

[51] Int. Cl.[6] ..... H01J 5/06

[52] U.S. Cl. ..... 313/634; 361/120; 361/117; 361/91; 361/220; 337/34; 337/28

[58] Field of Search ..... 313/635, 217, 25, 634; 361/120, 126, 220; 315/330; 337/20, 34

[56] References Cited

U.S. PATENT DOCUMENTS 3,588,576 6/1971 Kawiecki ..... 313/306
4,084,208 4/1978 Bazarian et al. ..... 361/120
4,631,453 12/1986 deSouza et al. ..... 315/340
4,661,747 4/1987 Gray, Sr. ..... 315/330
4,924,346 5/1990 Capps ..... 361/117

*Primary Examiner*—Donald J. Yusko
*Assistant Examiner*—Lawrence O. Richardson
*Attorney, Agent, or Firm*—Finnegan, Henderson, Farabow, Garrett & Dunner

[57] ABSTRACT

A flange, which is integrally formed with the inner surface of the cylindrical member, is located at an intermediate point between the end surface position of the cylindrical member to which the electrode plate of one of the discharge electrodes is sealed and the tip position of the discharge electrode portion of that electrode. Both end surfaces of the cylindrical member are hermetically attached with the discharge electrodes. This arrangement prevents inner flashovers without affecting the discharge characteristics of the discharge tube and also ensures manufacture of discharge tubes with no possibility of gas leakage with very high yields even if the machining precision is not so high.

2 Claims, 3 Drawing Sheets

GAS-FILLED DISCHARGE TUBE

BACKGROUND OF THE INVENTION

1. Field of the Invention

This invention relates to a gas-filled discharge tube and more particularly to a gas-filled discharge tube which prevents internal flashovers and assures production with high yields even if the machining precision is not so high.

2. Description of the Prior Art

Gas-filled discharge tubes, in which a sealed tube is filled with a gas and a voltage is applied across the electrodes provided at each end of the sealed tube to cause a discharge, have been in use in a variety of fields.

FIG. 3 shows a conventional gas-filled discharge tube 1. A cylindrical member 2 formed of an electrically insulating material such as ceramics has its open end portions metallized. The open end portions of the cylindrical member 2 are sealed with a pair of discharge electrodes 4, 4'—each of which consists of a metal electrode plate 4*a* and a discharge electrode portion 4*b*—by means of solder 3. The cylindrical member 2 is sealed with an inert gas such as argon gas at a pressure as high as several to twenty atmospheric pressures. Application of a certain voltage difference between the discharge electrodes 4, 4' causes an electric discharge in a gap G between the facing discharge electrode portions 4*b* , 4*b'* that have the steepest potential gradient.

In such a gas-filled discharge tube 1, it is known that the discharge characteristics are affected by the environment in which it is used. For example, if near the discharge tube 1 there is a grounded body (not shown) which is at the same potential as the discharge electrode 4' that is not applied with a voltage, a steep potential gradient may occur at other locations than the gap G between the discharge electrode portions, such as a joint portion between the cylindrical member 2 and the other discharge electrode 4 that is applied with a voltage. In such a case, as shown in FIG. 3, partial discharge glows or coronas 5 along the inner surface occur prior to the discharge between the discharge electrode portions 4*b*, 4*b'*. The partial discharge glows 5 develop into an internal flashover discharge 6 that envelops the entire inner surface of the cylindrical member 2. As a result, a starting voltage of a discharge required for the discharge gap cannot be obtained, changing the discharge characteristics of the discharge tube.

To eliminate this problem, it has been proposed to form a flange 7 integrally with and almost at the middle portion of the inner surface of the cylindrical member 2 in order to elongate the distance along the inner surface of the cylindrical member 2 between the discharge electrodes 4, 4', as shown in FIG. 4, thereby making the flashover along the inner surface difficult to occur.

With the discharge tube 1 shown in FIG. 4, however, since the flange 7 is formed projecting in a space A surrounding the gap G between the facing discharge electrode portions where the field intensity is strong, the electric field generated between the discharge electrode portions 4*b*, 4*b'* is disturbed by the flange 7, changing the discharge characteristics of the discharge tube 1.

To overcome this drawback, another method has been proposed. According to this method, as shown in FIG. 5, the flange 7 is formed integrally with one end portion of the cylindrical member 2 so as to project in a space B, which is remote from the gap G between the opposing discharge electrode portions so that the field intensity is not so strong as to affect the discharge characteristics. In the cup-shaped cylindrical member 2, one of the discharge electrodes 4 is sealed to the end surface of the flange 7 while the other discharge electrode 4' is sealed to the other end surface of the cylindrical member 2.

The above-mentioned conventional gas-filled discharge tube 1, however, has drawbacks. For example, where the cylindrical member 2 is formed of ceramics, it may be warped while being sintered. Further, as shown in FIG. 6, at the sealing portions between the cylindrical member 2 and the discharge electrodes 4, 4', the contact length x between one discharge electrode 4 and the end surface of the flange 7 is longer than that between the other discharge electrode 4' and the end surface of the cylindrical member 2. This increases a gap t formed between the first discharge electrode 4 and the flange 7, making it impossible to perfectly seal the gap between the discharge electrode 4 and the end surface of the flange 7 by solder 3. This in turn will lead to a possible leakage of the inert gas from the cylindrical member 2, lowering the yield during the manufacturing process.

Another type of discharge tube is available. As shown in FIG. 7, the discharge electrodes 8, 8' sealed to the end surfaces of the cylindrical member 2 are formed by press-forming thin metal plates. In addition to the warping of the cylindrical member 2 caused by sintering process, this type of discharge tube has another problem that the discharge electrodes 8, 8' may also be distorted while being press-formed. This causes the gap t formed between one of the discharge electrodes 8 and the flange 7 of the cylindrical member 2 to increase.

In either type of the above-mentioned discharge tubes, to prevent the gap t from being formed between the flange 7 of the cylindrical member 2 and one of the discharge electrodes 4, 8 requires enhancing the machining precision of both the cylindrical member 2 and the discharge electrodes 4, 8. This in turn results in a significant cost increase for manufacturing the discharge tube 1.

SUMMARY OF THE INVENTION

This invention has been accomplished with a view to overcoming the above drawbacks and its objective is to provide a gas-filled discharge tube, which prevents flashover along the inner surface of the tube without affecting the discharge characteristics and which assures high yields even when the machining precision is not so high.

To achieve the above objective, the gas-filled discharge tube of this invention comprises: an electrically insulating cylindrical member sealed with an inert gas; a pair of discharge electrodes hermetically secured to both open ends of the cylindrical member, said discharge electrodes having discharge electrode portions facing each other; and a flange formed integrally at least on the inner surface of the cylindrical member at an intermediate position between the end surface position of the cylindrical member to which a flange portion of one of the discharge electrodes is sealed and the tip position of the discharge electrode portion of said electrode.

With this invention, since the flange, which is formed integrally on the inner surface of the cylindrical member, is located at least between the end surface position of the cylindrical member to which the flange portion of one of the discharge electrodes is sealed and the tip position of the discharge electrode portion of that electrode, the flashover along the inner surface of the cylindrical member can be prevented without affecting the discharge characteristics of the discharge tube.

Furthermore, since the discharge electrodes are sealed to both end surfaces of the cylindrical member so that the contact lengths between the cylindrical member and the discharge electrodes are small, the gap formed between the cylindrical member and the discharge electrodes becomes very small and thus can reliably be sealed by a soldering material. It is therefore possible to manufacture discharge tubes with no possibility of gas leakage at very high yields even if the machining precision is not so high.

DETAILED DESCRIPTION OF PREFERRED EMBODIMENT

Now, embodiments of this invention will be described by referring to FIG. 1 and FIG. 2.

Figure 1:
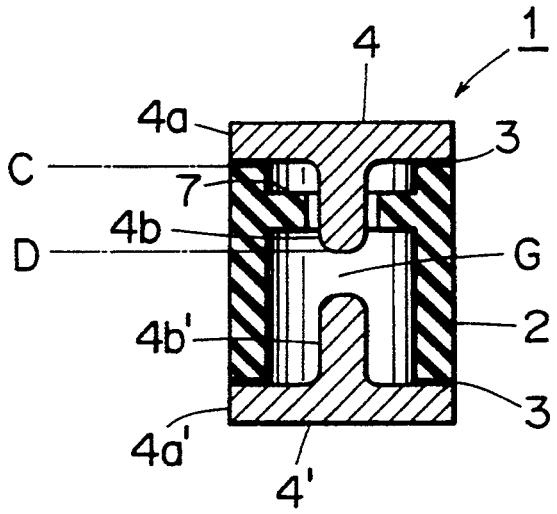
FIG. 1 is a cross section of one embodiment of the gas-filled discharge tube according to this invention.

FIG. 1 shows one embodiment of the gas-filled discharge tube according to this invention. A cylindrical member 2 formed of an electrically insulating material such as ceramics has its open end portions metallized. The open end portions of the cylindrical member 2 are sealed with a pair of discharge electrodes 4, 4'—each of which consists of a metal electrode plate 4*a* and a discharge electrode portion 4*b*—by means of solder 3. The cylindrical member 2 is sealed with an inert gas such as argon gas at a pressure as high as several to twenty atmospheric pressures. Application of a certain voltage difference between the discharge electrodes 4, 4' causes an electric discharge in a gap G between the facing discharge electrode portions 4*b*, 4*b*' that have the steepest potential gradient.

In this embodiment, the cylindrical member 2 has its inner surface formed integral with a flange 7 at almost a midway point between the end portion C of the cylindrical member 2 to which the electrode plate 4*a* of one electrode 4 is sealed and the tip portion D of the discharge electrode portion 4*b* of the first electrode 4. The inner end of the flange 7 extends near the circumference of the first discharge electrode portion 4*a*.

Next, the working of this embodiment will be explained.

In this embodiment, if near the discharge tube 1 there is a grounded body (not shown) which is at the same potential as the second discharge electrode 4' that is not applied with a voltage, a steep potential gradient may occur at other locations than the gap G between the discharge electrode portions, such as a joint portion between the cylindrical member 2 and the first discharge electrode 4 that is applied with a voltage. In such a case, partial discharge glows or coronas 5 along the inner surface may occur prior to the discharge between the discharge electrode portions 4*b*, 4*b*'. The provision of the flange 7 on the inner surface of the cylindrical member 2, however, elongates the distance along the inner surface of the cylindrical member 2 between the discharge electrodes 4, 4' thus preventing the partial coronas along the inner surface from developing into a full flashover.

In this respect, this embodiment has a special arrangement in the discharge tube 1. That is, in the discharge tube 1 the flange 7 is located almost at the midway point between the end surface position C of the cylindrical member 2 to which the electrode plate 4*a* of the first discharge electrode 4 is sealed and the tip position D of the discharge electrode portion 4*b* of the first electrode 4—a position that is remote from the gap G between the opposing discharge electrode portions so that the field intensity at this portion is not so strong. Because of this arrangement, the electric field formed between the discharge electrode portions 4*b*, 4*b*' will not be disturbed by the flange 7, reducing the possibility of the discharge characteristics being affected.

Another feature is that unlike the conventional discharge tube in which one of the discharge electrode is sealed to the end surface of the flange formed at the end surface portion of the cylindrical member, this invention has the discharge electrodes 4, 4' sealed to both end surfaces of the cylindrical member so that the contact lengths between the cylindrical member and the discharge electrodes 4, 4' are short. Therefore, if the cylindrical member 2 is warped during the sintering process, the gaps between the cylindrical member 2 and the discharge electrodes 4, 4' remain very small and can be completely sealed by solder 3 during the process of soldering the discharge electrodes 4, 4', eliminating the possibility of gas leakage that would otherwise be caused by these gaps. This arrangement reliably prevents the occurrence of gaps by soldering even when the machining precision is not so high, ensuring high productivity in the manufacture of the discharge tubes.

Since the flange 7 is formed integrally with the cylindrical member 2 at an intermediate point between the end surface position of the cylindrical member 2 to which the electrode plate 4*a* of the first discharge electrode 4 is sealed and the tip position of the discharge electrode portion 4*b* of that discharge electrode 4, and since the discharge electrodes 4, 4' are attached to both end surfaces of the cylindrical member 2, it is possible to prevent flashovers along the inner surface without affecting the discharge characteristics of the discharge tube. Further, it is also possible to manufacture at very high yields the discharge tubes that have no possibility of gas leakage even when the machining precision is not so high.

Figure 2:
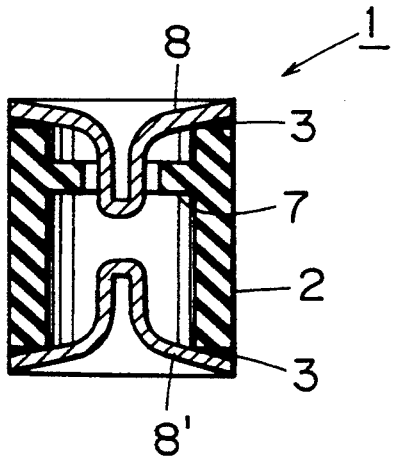
FIG. 2 is a cross section of another embodiment of the invention.
Figure 3:
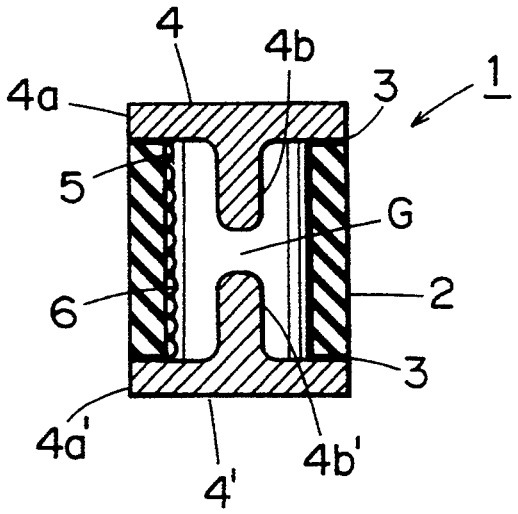
FIG. 3 PRIOR ART
FIG. 3 is a cross section of a conventional gas-filled discharge tube.
Figure 4:
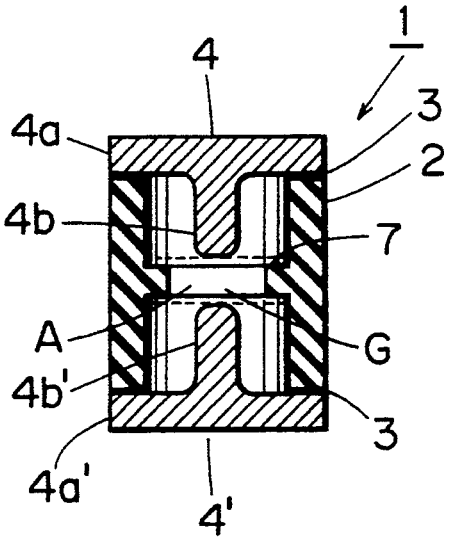
FIG. 4 PRIOR ART
FIG. 4 is a cross section of another example of the conventional gas-filled discharge tube.
Figure 5:
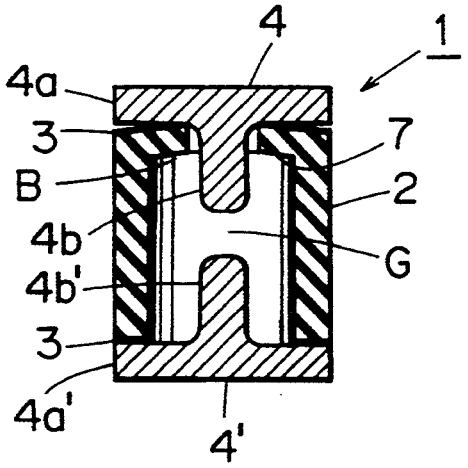
FIG. 5 PRIOR ART
FIG. 5 is a cross section of still another example of the conventional gas-filled discharge tube.
Figure 6:
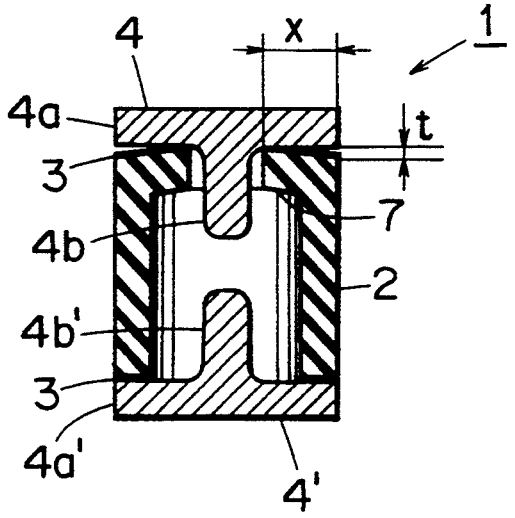
FIG. 6 PRIOR ART
FIG. 6 is a cross section showing the gap formed in the conventional gas-filled discharge tube of FIG. 5.
Figure 7:
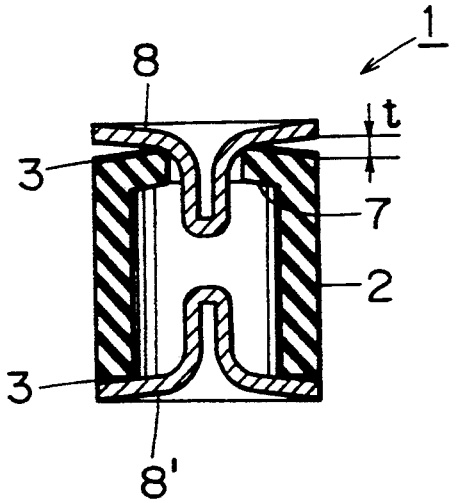
FIG. 7 PRIOR ART
FIG. 7 is a cross section of still another example of the conventional gas-filled discharge tube.

FIG. 2 shows another embodiment of this invention. The discharge electrodes 8, 8' sealed to the end surfaces of the cylindrical member 2 are each formed in one piece by press-forming a thin metal plate. The construction in other respects is similar to that of the above embodiment.

In this embodiment, in addition to the warping of the cylindrical member 2 caused by the sintering process, the discharge electrodes 8, 8' may also be distorted during their press-forming. As with the previous embodiment, however, by forming the flange 7 in the inner surface of the cylindrical member 2 and sealing the discharge electrodes 8, 8′ to both end surfaces of the cylindrical member 2, it is possible to prevent flashover along the inner surface without affecting the discharge characteristics of the discharge tube and to manufacture the discharge tubes with no possibility of gas leakage with very high yields.

While, in either of the above-mentioned embodiments, the flange 7 is formed only on one side of the cylindrical member 2, i.e. on the side where one discharge electrode 4, 8 is provided, it is also possible to form another flange on the other side of the cylindrical member 2, i.e. on the side where the second discharge electrode 4′, 8′ is provided, in order to prevent internal flashover more reliably.

The flange 7 is not limited to the shape shown in either of FIGS. 1 or 2 but various modifications may be made. The size of the flange may be determined according to the longitudinal length and diameter of the cylindrical member 2.

As mentioned above, the flange, which is integral with the cylindrical member, is formed at least in the inner surface of the cylindrical member at an intermediate position between the end surface position of the cylindrical member to which one of the discharge electrodes is sealed and the tip position of the discharge electrode portion of that electrode. Further, the discharge electrodes are sealed to the end surfaces of the cylindrical member. Because of this construction, it is possible to prevent internal flashovers without affecting the discharge characteristics of the discharge tube and also assure manufacture of discharge tubes with no possibility of gas leakage at very high yields.

What is claimed is:

1. A gas-filled discharge tube comprising:

an electrically insulating cylindrical member sealed with an inert gas;

a pair of discharge electrodes having flange formations hermetically secured to both open ends of the cylindrical member, said discharge electrodes extending axially of the cylindrical member, the flange formations terminating in tips facing each other; and an inner surface of the cylindrical member having an electrically insulating, inwardly directed flange at an intermediate axial position between an end surface position of the cylindrical member to which the flange portion of at least one of the discharge electrodes is sealed and the axial position of the tip of the discharge electrode.

2. A gas-filled discharge tube as claimed in claim 1, further comprising a second flange formed at an intermediate position between the end surface position of the cylindrical member to which a flange portion of the other of said discharge electrodes is sealed and the tip position of said other electrode.

* * * * *